US007021189B2

(12) United States Patent
Patry et al.

(10) Patent No.: US 7,021,189 B2
(45) Date of Patent: Apr. 4, 2006

(54) TURRET FOR A MILITARY VEHICLE

(75) Inventors: Jean Noël Patry, Voisin le Bretonneux (FR); Manuel Berejnoi, Paris (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/501,408

(22) PCT Filed: Jan. 22, 2003

(86) PCT No.: PCT/FR03/00214

§ 371 (c)(1),
(2), (4) Date: Jul. 15, 2004

(87) PCT Pub. No.: WO03/062732

PCT Pub. Date: Jul. 31, 2003

(65) Prior Publication Data

US 2005/0115396 A1 Jun. 2, 2005

(30) Foreign Application Priority Data

Jan. 22, 2002 (FR) ..... 02 00731

(51) Int. Cl.
*F41A 9/38* (2006.01)

(52) U.S. Cl. ..... 89/45; 89/36.14; 89/37.07

(58) Field of Classification Search ..... 89/36.13, 89/36.14, 45, 46, 37.07
See application file for complete search history.

(56) References Cited

U.S. PATENT DOCUMENTS

| | | | | |
|---|---|---|---|---|
| 1,578,310 | A | 3/1926 | Campbell, Jr. et al. | 109/58.5 |
| 2,357,209 | A * | 8/1944 | Lanciani | 89/37.16 |
| 3,333,507 | A * | 8/1967 | De Meiss | 89/36.13 |
| 3,710,681 | A * | 1/1973 | Koontz | 89/36.14 |
| 3,854,377 | A | 12/1974 | Schiele | |
| 4,088,058 | A * | 5/1978 | Flemming et al. | 89/36.13 |
| 4,352,315 | A * | 10/1982 | Ingestrand | 89/36.14 |
| 4,635,529 | A * | 1/1987 | Tassie | 89/36.14 |
| 4,777,864 | A * | 10/1988 | Siech et al. | 89/45 |
| 4,840,108 | A * | 6/1989 | Hurlemann et al. | 89/33.14 |
| 5,945,625 | A * | 8/1999 | Zielinski | 89/36.13 |
| 6,286,411 | B1 * | 9/2001 | Sanderson | 89/37.16 |

FOREIGN PATENT DOCUMENTS

| | | |
|---|---|---|
| EP | 0 141 018 A2 * | 5/1985 |
| GB | 1019430 | 2/1966 |

* cited by examiner

*Primary Examiner*—Stephen M. Johnson
(74) *Attorney, Agent, or Firm*—Oliff & Berridge, PLC

(57) ABSTRACT

A turret for a military vehicle, mobile in traverse with respect to said vehicle and supporting an oscillating mass notably comprising a cannon oriented in elevation, wherein said oscillating mass is mounted in said turret using a linking interface ensuring the air-tightness of said mass with respect to the exterior of said turret, said interface ensuring the mobility in elevation of said cannon.

20 Claims, 4 Drawing Sheets

TURRET FOR A MILITARY VEHICLE

BACKGROUND OF THE INVENTION

1. Field of Invention

The technical scope of the present invention is that of turrets intended for military vehicles and supporting an oscillating mass integrating a cannon.

2. Description of Related Art

The mounting of an oscillating mass onto a turret generally allows said oscillating mass to move in rotation around an axis that is fixed with respect to the turret, commonly called rotation in elevation. Moreover, the turret is itself able to rotate with respect to the vehicle, commonly called rotation in traverse. The latter rotation does not in general pose any particular problems. However, rotation in elevation poses problems that are difficult to solve for clearances of the gun cannon of around 100° with respect to the turret.

It is essential to insulate the turret with respect to the exterior so as to avoid any contamination and to ensure the evacuation of the combustion gases produced when the ammunition is fired and also naturally that of the empty cases or bases after the ammunition has been fired.

Furthermore, the oscillating mass is piloted and powered from the turret, which requires a communication to be established to ensure these functions whilst avoiding the propagation of gaseous combustion residues from the cannon to the turret.

Lastly, the oscillating mass is made to communicate with the exterior so that the combustion gases and the cases or bases may be evacuated. The oscillating mass also needs to be made air tight with respect to the exterior.

A turret has already been proposed that is insulated from the exterior by sealing means placed between this turret and the oscillating mass. For this, a seal is mounted on the turret surrounding the window required for the intended clearance of the oscillating mass. The contact of the seal lip on a cylindrical surface centered on the axis of rotation of the oscillating mass and connected to the oscillating mass ensures this sealing. However, this solution requires a radius for the cylindrical surface that is all the wider in that the clearance of the oscillating mass is substantial. Thus, for large clearances of the oscillating mass, for example 100°, the height of the turret presents a handicap for its bulk, for its discretion or for the mass of the assembly. Additionally, through friction, this seal produces a disturbance due to its resistance to the rotation of the oscillating mass. This disturbance is undesirable in that it forms the equivalent of a boundary friction that disturbs the accurate aiming of the oscillating mass on a target using an instruction transmitted by the servo controls to the elevation positioning means of the mass.

SUMMARY OF THE INVENTION

The aim of the present invention is to design a new organization of the structure of a turret carrying an oscillating mass that allows a wide clearance of the oscillating mass and provides insulation to the exterior and this whatever the angular position of the oscillating mass.

The invention thus relates to a turret for a military vehicle, mobile in traverse with respect to said vehicle and supporting an oscillating mass notably comprising a cannon oriented in elevation, wherein the oscillating mass is mounted in the turret using a linking interface ensuring the air-tightness of the mass with respect to the exterior of the turret, the interface ensuring the mobility in elevation of the cannon.

According to one characteristic of the invention, the interface is constituted by a closed caisson inside which the weapon is able to slide when ammunition is being fired, the caisson being mounted mobile in elevation in the turret.

According to yet another characteristic of the invention, the caisson is integral with the turret by means of a right trunnion and a left trunnion.

According to yet another characteristic of the invention, the right trunnion is hollow so as to make the inside of the caisson communicate with the inside of the turret.

According to yet another characteristic of the invention, the left trunnion communicates with the exterior by means of a calibrated sealing organ.

According to yet another characteristic of the invention, the caisson is fitted with a non-return valve communicating with the exterior and allowing the pressure level inside the caisson to be adjusted.

According to yet another characteristic of the invention, the trunnions have an internal diameter that is sufficient to ensure a passage for the ammunition cases and their evacuation outside of the turret.

Advantageously, the cases are evacuated via the sealing organ.

According to yet another characteristic of the invention, the turret may incorporate reception means for the cases that are fastened to the sealing organ.

According to yet another characteristic of the invention, the turret is equipped with means to draw in and filter the outside air to ensure an overpressure inside the turret.

According to yet another characteristic of the invention, the caisson is articulated by bearings mounted on the trunnions.

According to yet another characteristic of the invention, the turret may incorporate storage means for the cases that are integral with the sealing organ.

Advantageously, the turret is equipped with a medium calibre cannon, for example a 40 mm cannon.

A first advantage of the turret according to the invention lies in the simple design of the oscillating mass integrated in the turret to ensure a wide clearance.

Another advantage lies in the facilitated integration of the sealing means for the oscillating mass.

Another advantage lies in the fact that the air-tightness of the turret is ensured by the oscillating mass.

Yet another advantage lies in the fact that the boundary friction is reduced, thereby reducing the disturbances in the aiming of the oscillating mass.

Yet another advantage of the invention lies in the fact that the rigidity of the closed caisson contributes to placing the first modes of the caisson's excitation rate at a higher value given by the movements of the oscillating mass controlled by the actuator.

BRIEF DESCRIPTION OF THE DRAWINGS

Other characteristics, particulars and advantages of the invention will become more apparent from the description given hereafter by way of illustration and with reference to the appended drawings, in which.

DETAILED DESCRIPTION OF PREFERRED EMBODIMENTS

Figure 1:
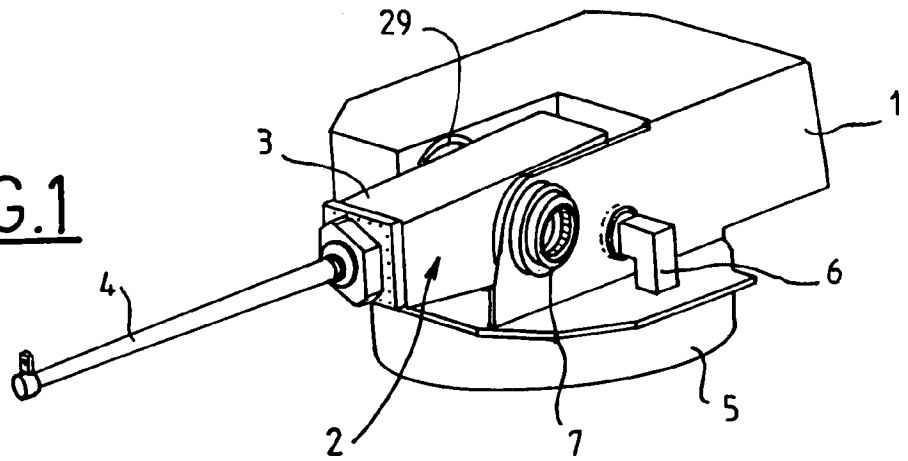
FIG. 1 is an overall view of the turret.

FIG. 1 shows a turret 1 intended to equip a military vehicle not shown and which supports an oscillating mass 2 enclosed in a caisson 3 of which only the cannon 4 can be seen. The turret 1 incorporates a base 5 allowing it to be connected in a rotating manner with respect to the vehicle onto which it will be mounted. The turret 1 incorporates actuating means 6 allowing the oscillating mass 2 to be pivoted in elevation around a left trunnion 7 and right trunnion 29, only the left trunnion being visible in the plane of the Figure.

Figure 2:
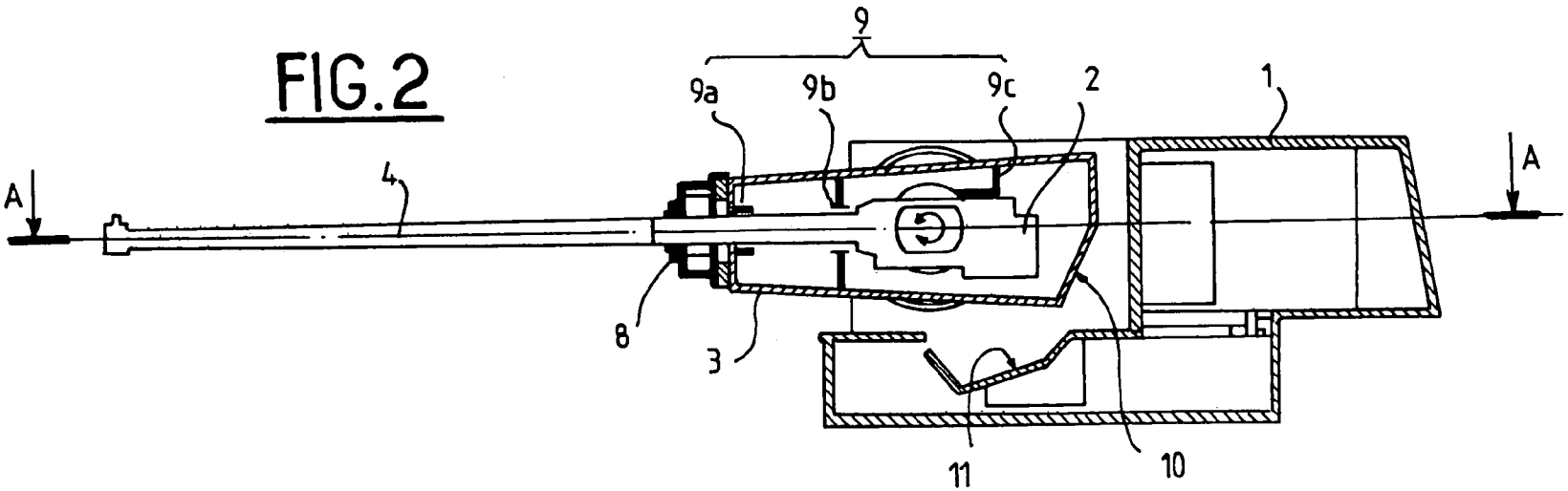
FIG. 2 is a vertical section of the turret through the cannon axis.

In FIG. 2, a vertical section shows the integration of the oscillating mass 2, extended by the cannon 4 in the caisson 3. We see that the oscillating mass 2 is mounted in the turret 1 using a linking interface constituted by the caisson 3. On the cannon 4, the oscillating mass is provided with a seal 8 ensuring air-tightness. The cannon 4 slides in the caisson 3 with respect to the oscillating mass 2 after every firing by means of a positioning mechanism 9, that is 9*a*, 9*b* and 9*c*. The rear part 10 of the caisson 3 matches the shape of the corresponding lower part 11 of the turret 1. This embodiment allows the required clearance of the oscillating mass to be ensured without encroaching upon the available space in the turret. The weapon, represented by its cannon 4, is able to slide when ammunition is being fired and the caisson 3 is itself mounted mobile in elevation in the turret.

Figure 3:
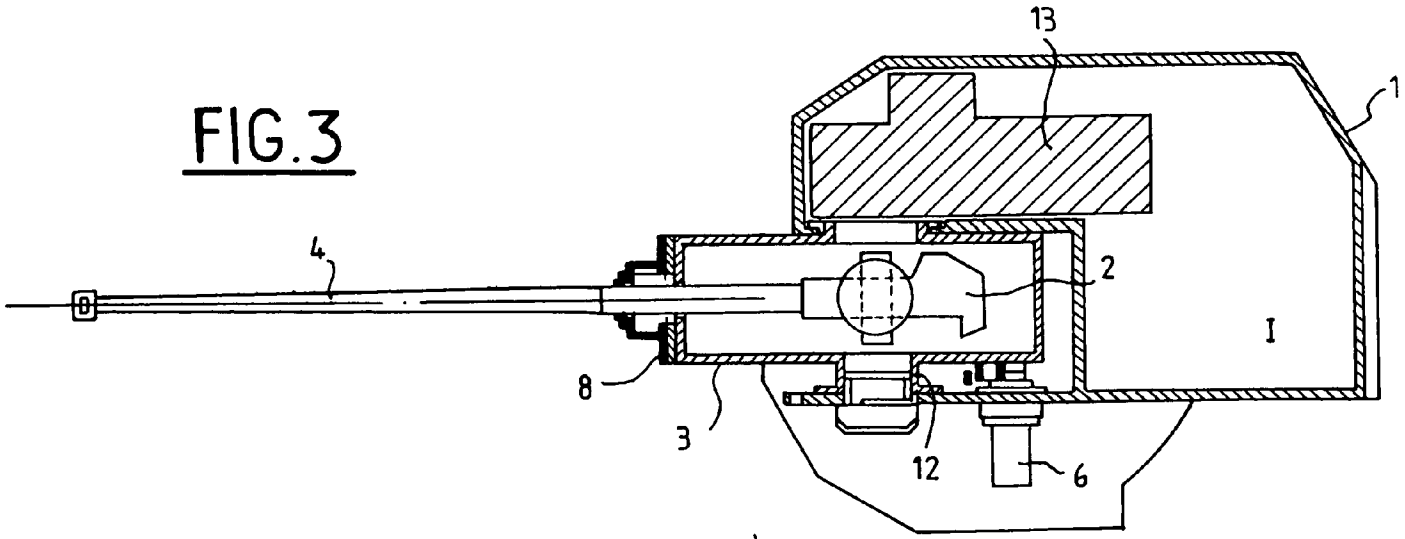
FIG. 3 is a section AA of FIG. 2.

In FIG. 3, which is a section AA of FIG. 2, we see that the caisson 3 is equipped with trunnions 12 on either side allowing it to be fastened in the turret 1 and ensuring its rotation in elevation using means 6 in a known manner. The means 6 are constituted, for example, by a motor integral with the turret and whose output pinion meshes on a wheel integral with the oscillating mass. The turret incorporates a unit 13 to store and transfer ammunition towards the weapon 2. We also see that the inside of the caisson 3 communicates via the trunnions 12 with the inside I of the turret 1. These trunnions 12 are constituted by a substantially sized drill hole extended by an external crown onto which the articulation bearing of the caisson with respect to the turret is mounted. This articulation is made air-tight with respect to the exterior of the turret in a known manner, for example using a lip seal, said interface thus ensuring the cannon's mobility in elevation.

Figure 4:
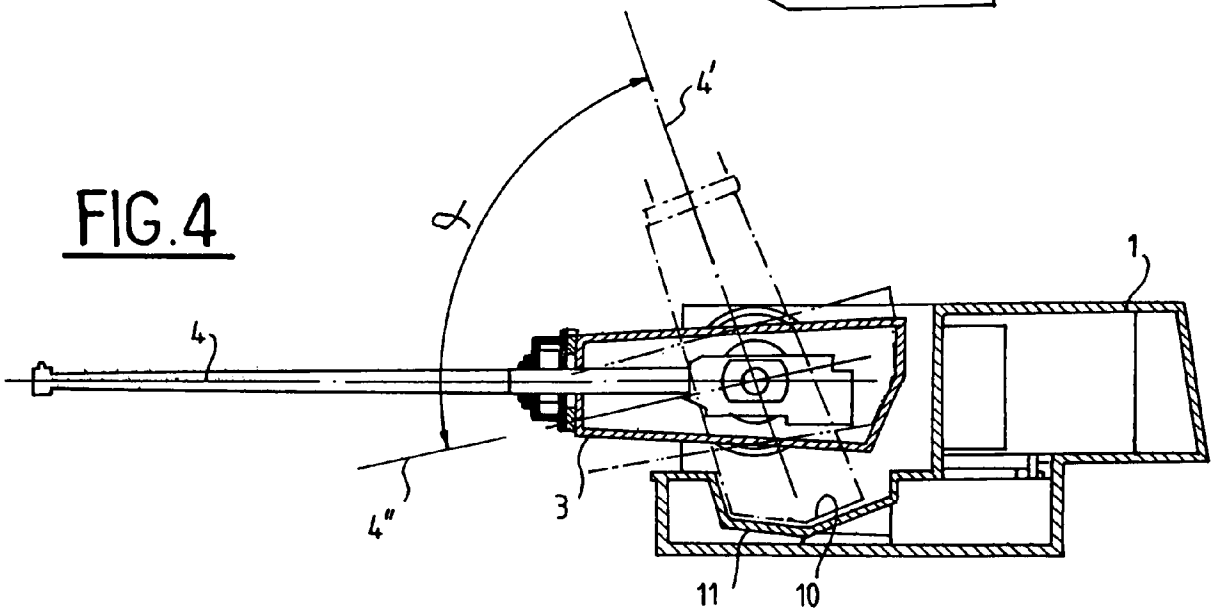
FIG. 4 shows the range of the oscillating mass with respect to the turret.

FIG. 4 shows both extreme positions of the caisson 3 with respect to the turret 1, positions that are obtained using the actuating means 6. The angle $\alpha$ defines the clearance angle of the cannon 4 between a high position 4' and a low position 4". The clearance angle between position 4' and 4" is of around 100°. Thus, if we consider a starting position of the cannon 4 at a nil angle $\alpha$, position 4' defines an angle of around +85° and position 4" an angle of around −15°. Once again, we see on the Figure that in position 4', the rear part 10 of the caisson 3 fits around the matching shape 11 facing the turret. Thus, the turret according to the invention ensures air-tightness with respect to the exterior as well as a substantial clearance of the cannon without any disturbance to the functioning of the weapon whilst being simple in architecture.

Figure 5:
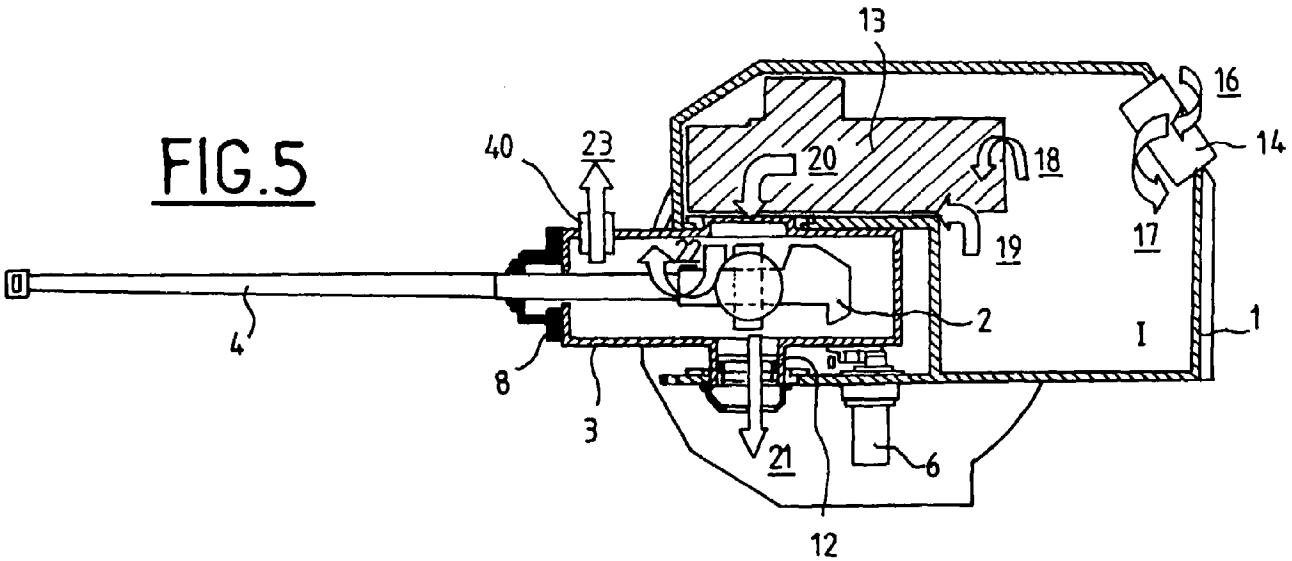
FIG. 5 illustrates the air circulation in the turret.

FIG. 5 shows the principle of air circulation in the turret 1 and the interface 2 and more specifically in the caisson 3. The caisson 3 is provided with a non-return valve 40 that communicates with the exterior allowing the pressure inside it to be adjusted. The turret 1 is equipped with means 14 to draw in and filter air from outside. This intake of air is provided so as to give the turret 1 an overpressure with respect to the exterior and to evacuate the tainted air outside. The overpressure is of around 10% over the exterior pressure. The air flow is carried out in the following manner and is schematized by arrows 16–23. The air penetrates at 16 by being drawn in by the aspirator 14 and circulates inside the turret 1 through the unit 13 at 18 and between the unit 13 and the turret wall at 19; it then reaches the trunnion at 20 to circulate in the interface 2 and escapes either via the trunnion at 21 or via the valve 40 at 22, 23. Given that the aspirator 14 creates an overpressure in the turret, insulation is ensured as a result.

The turret 1 according to the invention also allows the empty cases or ammunition bases to be evacuated after firing. This evacuation is carried out via the trunnions 12 that are of a large diameter, that is a diameter wide enough to provide a passage for a piece of medium calibre ammunition, for example 40 mm. To this end, upon exiting the oscillating mass, the case is taken up by a mechanism not shown, a thrustor for example, that pushes it from the unit 13 through the other trunnion until its complete exit.

Figure 7:
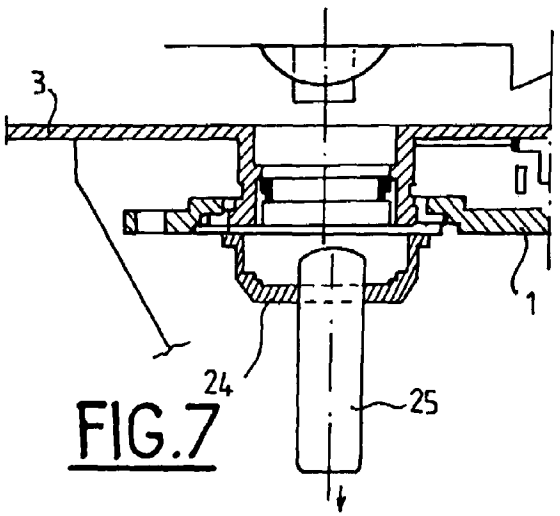
FIGS. 6 and 7 show the expulsion of an empty stub outside.
Figure 6:
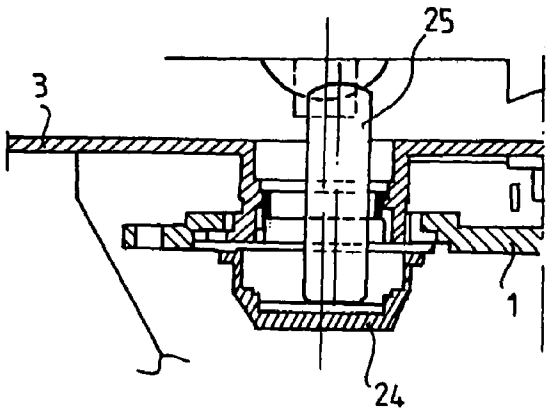

FIGS. 6 and 7 represent the two main stages in this phase. Given that the trunnions 12 are hollow so as to allow the inside of the caisson to communicate with the inside of the turret 1, it is easy for a calibrated sealing organ 24 to be positioned so as to make the turret 1 communicate with the exterior. The organ 24 may, for example, be a diaphragm whose lips remain closed between the passage of two consecutive cases, as shown in FIG. 6. These lips are made to open for the passage of the case 25, as shown in FIG. 7. As it advances, pushed by the thrustor, the case causes the means 24 to open. Given that the inside of the turret is overpressured, a leak from the organ 24 causes no problems. There are air leaks, but the tainted external air is not able to penetrate the inside of the turret. FIG. 7 shows the expulsion position of the case 25 that has partly passed through the sealing organ 24. At the end of its displacement, the empty case falls, for example, into a case bag 39 in order to be removed later on.

Figure 8:
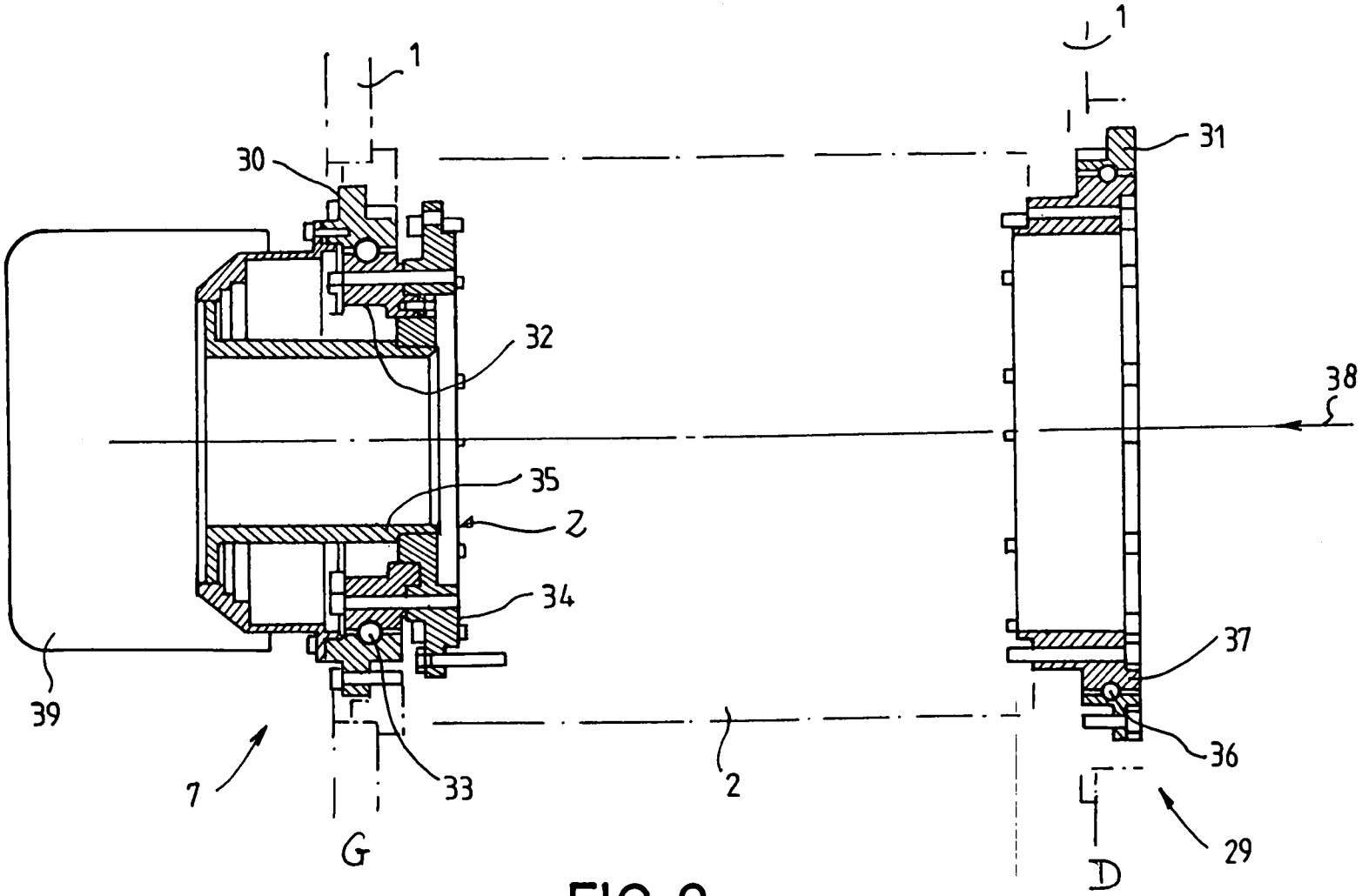
FIG. 8 is a section showing the trunnions.

FIG. 8 shows a detail in the embodiment of the link between the trunnion and the turret ensuring the rotation of the interface 2 with respect to the turret 1 using the left 7 or right 29 trunnion. To this end, a left bearing 30 and a right bearing 31, in the plane of the Figure, are provided on either side of the interface 2. The external housing 33 of the left bearing 30 is integral with the trunnion whereas the internal housing 32 is integral with the interface 2. The external housing 33 has no particularities whereas the internal housing 32 supports a connection mechanism 34 for the interface 2. This mechanism 34 notably comprises a cylindrical tube 35 whose internal diameter is intended to allow a passage for the empty case. The external housing 36 of the right bearing 31 has no particularities and the internal housing 37 has a diameter wide enough to allow a passage for the ammunition 38 from the turret 1 to the interface 2.

This internal diameter may be greater than that of the cylindrical tube, as may be seen in the Figure, to facilitate this introduction. A thrustor shown in the form of arrow 38 allows the interface 2 to be supplied with ammunition. The empty cases that exit on the left side may be gathered in a bag 39 attached to the end of the barrel 35. Naturally, sealing means are provided for the left bearing 30. Since these means are classical they do not need further explanation.

What is claimed is:

1. A turret for a military vehicle, the turret mobile in traverse with respect to the vehicle, comprising:

an oscillating mass comprising a cannon oriented in elevation; and a linking interface used to mount the oscillating mass in the turret, the inking interface ensuring air-tightness with respect to the exterior of the turret, wherein the linking interface includes an airtight caisson insulating the turret with respect to the exterior, the caisson being mobile in elevation in the turret.

2. The turret for a military vehicle according claim 1, wherein in the linking interface including the closed caisson the cannon is able to slide when ammunition is being fired, the caisson being mounted mobile in elevation in the turret.

3. The turret for a military vehicle according to claim 2, wherein the caisson is integrated with the turret by means of a left trunnion and a right trunnion.

4. The turret for a military vehicle according to claim 3, wherein the caisson is articulated by bearings mounted on the right and left trunnions.

5. The turret for a military vehicle according to claim 3, wherein the right trunnion is hollow so as to communicate the inside of the caisson with the inside of the turret.

6. The turret for a military vehicle according to claim 5, further comprising a calibrated sealing organ, wherein the left trunnion is hollow and communicates with the exterior of the turret by means of the calibrated sealing organ.

7. The turret for a military vehicle according to claim 6, further comprising a non-return valve fitted to the caisson, the non-return valve communicating with the exterior and allowing the pressure level inside the caisson to be adjusted.

8. The turret for a military vehicle according to claim 7, wherein the left and right trunnions have an internal diameter that is sufficient to ensure a passage for ammunition cases and their evacuation outside of the turret.

9. The turret for a military vehicle according to claim 8, wherein the ammunition cases are evacuated via the calibrated sealing organ.

10. The turret for a military vehicle according to claim 9, wherein the turret incorporates reception means for the ammunition cases, fastened to the calibrated sealing organ.

11. The turret for a military vehicle according to claim 10, further comprising storage means for the ammunition cases.

12. The turret for a military vehicle according to claim 1, further comprising means to draw in and filter the outside air to create an overpressure inside the turret.

13. The turret for a military vehicle according to claim 1, wherein the turret is equipped with a medium calibre cannon.

14. The turret for a military vehicle according to claim 13, wherein the medium calibre cannon is a 40 mm cannon.

15. A turret for a military vehicle, comprising:

an aspirator mounted in a wall of the turret;

a cassion provided with a one way value, the cassion being mounted in the turret and mobile in elevation; and an oscillating mass comprising a weapon system mounted in the caisson, wherein the aspirator creates an overpressure in the turret such that outside air cannot enter the turret thereby making the turret airtight to the outside air, and the turret is mobile in traverse with respect to the vehicle.

16. The turret according to claim 15, wherein the aspirator includes a filter.

17. The turret according to claim 15, wherein the caisson is sealably mounted in a recess in the turret by a pair of trunnions.

18. The turret according to claim 17, wherein a first trunnion of the pair of trunnions communicates inside of the caisson with inside the turret.

19. The turret according to claim 18, further comprising a calibrated sealing organ such that a second trunnion of the pair of trunnions communicates with exterior of the turret by means of the calibrated sealing organ.

20. The turret according to claim 15, wherein the one way value is mounted in a part of the caisson.

* * * * *